US008287087B2

(12) United States Patent
Sano

(10) Patent No.: US 8,287,087 B2
(45) Date of Patent: Oct. 16, 2012

(54) INK DISCHARGING DEVICE AND METHOD OF CONTROLLING THE INK DISCHARGING DEVICE

(75) Inventor: Toshiyuki Sano, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 407 days.

(21) Appl. No.: 12/610,168

(22) Filed: Oct. 30, 2009

(65) Prior Publication Data

US 2010/0110118 A1 May 6, 2010

(30) Foreign Application Priority Data

Oct. 31, 2008 (JP) ..... 2008-280881

(51) Int. Cl.
*B41J 2/165* (2006.01)

(52) U.S. Cl. ..... 347/35; 347/23; 347/36

(58) Field of Classification Search ..... 347/23, 347/34–36

See application file for complete search history.

(56) References Cited

U.S. PATENT DOCUMENTS

| | | | | |
|---|---|---|---|---|
| 5,903,288 | A * | 5/1999 | Yamaguchi | 347/24 |
| 6,695,430 | B2 | 2/2004 | Arai et al. | |
| 6,739,696 | B2 | 5/2004 | Arai et al. | |
| 7,147,298 | B2 * | 12/2006 | Usuda | 347/35 |
| 2004/0160475 | A1 * | 8/2004 | Satoh et al. | 347/36 |

FOREIGN PATENT DOCUMENTS

| | | | |
|---|---|---|---|
| JP | 2002-225305 | A | 8/2002 |
| JP | 2003-001835 | A | 1/2003 |
| JP | 2003-127429 | A | 5/2003 |

* cited by examiner

*Primary Examiner* — Jason Uhlenhake
(74) *Attorney, Agent, or Firm* — Baker Botts L.L.P.

(57) ABSTRACT

An ink discharging device may comprise a head that is configured to print an image by discharging black ink and ink other than the black ink onto a print medium. The ink discharging device may further comprise a print controller that is configured to control the head such that the image is printed on the print medium on the basis of print data. The print controller may be configured to control the head such that flushing of the ink other than the black ink is performed at a black-color print area on the print medium onto which the head discharges the black ink on the basis of the print data.

9 Claims, 10 Drawing Sheets

INK DISCHARGING DEVICE AND METHOD OF CONTROLLING THE INK DISCHARGING DEVICE

CROSS REFERENCE TO RELATED APPLICATION

This application claims priority to Japanese Patent Application NO. 2008-280881, filed Oct. 31, 2008, the entire subject matter and disclosure of which is incorporated herein by reference.

BACKGROUND OF THE DISCLOSURE

1. Field of the Disclosure

The features herein relate to an ink discharging device comprising a head that is configured to print an image by discharging ink onto a print medium, and a method of controlling the ink discharging device.

2. Description of the Related Art

In a known inkjet printer, flushing in which ink is discharged from nozzles is periodically performed for preventing thickening of ink in the nozzles of a head and for maintaining good discharging performance. The flushing and printing an image position detection mark may be carried out on a print area of a print medium at the same time.

However, since it is necessary to provide a mark print area on a sheet, the print medium cannot be efficiently used.

SUMMARY OF THE DISCLOSURE

A need has arisen for an ink discharging device and a method for controlling the ink discharging device allowing efficiently using the print medium even when flushing is carried out.

According to one embodiment herein, an ink discharging device may comprise a head that is configured to print an image by discharging black ink and ink other than the black ink onto a print medium. The ink discharging device may further comprise a print controller that is configured to control the head such that the image is printed on the print medium on the basis of print data. The print controller may be configured to control the head such that flushing of the ink other than the black ink is performed at a black-color print area on the print medium onto which the head discharges the black ink on the basis of the print data.

According to another embodiment herein, a method of controlling an ink discharging device, that is configured to print an image by discharging black ink and ink other than the black ink onto a print medium from a head, may comprise the step of performing flushing of the ink other than the black ink at a black-color print area on the print medium onto which the black ink is discharged on the basis of the print data. The method of controlling an ink discharging device may further comprise the step of performing black-color printing, in which the black ink is discharged, at the black-color print area after the flushing.

According to yet another embodiment herein, an ink discharging device may comprise a head that is configured to print an image by discharging ink onto a print medium. The ink discharging device may further comprise a print controller that is configured to control the head such that the image is printed onto the print medium on the basis of print data. The print controller may be configured to control the head such that flushing of ink of a color that is the same as that of the ink that is discharged is performed at a print area on the print medium onto which the head discharges the ink on the basis of the print data.

DESCRIPTION OF EMBODIMENTS

Various embodiments, and their features and advantages, may be understood by referring to FIGS. 1-10, like numerals being used for corresponding parts in the various drawings.

Figure 1:
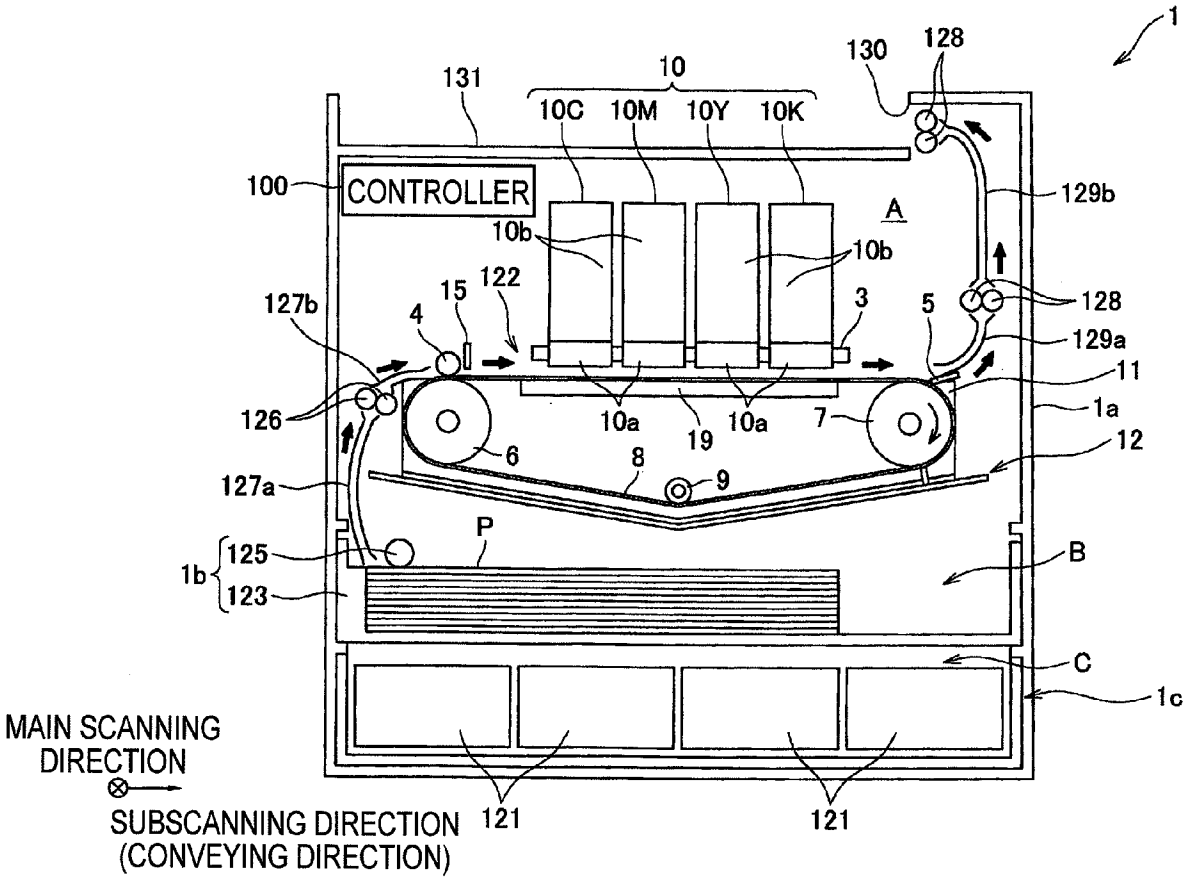
FIG. 1 is a side sectional view of an inkjet printer according to an embodiment of the invention.

Referring to FIG. 1, an inkjet printer 1 includes a rectangular parallelepiped housing 1*a*. A sheet-discharge section 131 that receives printed sheets P discharged from an opening 130 is formed at the upper portion of a top plate of the housing 1*a*. A space in the housing 1*a* is partitioned into spaces A, B, and C in that order from the top. A plurality of, e.g., four, inkjet heads 10 (heads 10C, 10M, 10Y, and 10K that discharge cyan ink, magenta ink, yellow ink, and black ink, respectively), a conveying unit 122 that conveys sheets P, and a controller 100 that controls the operation of each portion of the printer 1 are positioned in the space A. Each head 10 is disposed such that the longitudinal direction is along a main scanning direction. The conveying unit 122 conveys the sheets P in a subscanning direction. A sheet-feed unit 1*b* and an ink tank unit 1*c* that are removable from the housing 1*a* in the main scanning direction are positioned in the spaces B and C, respectively.

The ink tank unit 1*c* includes a plurality of, e.g., four, main tanks 121 that store the inks of the respective colors corresponding to the plurality of heads 10C, 10M, 10Y, and 10K. The main tanks 121 are connected to their respective heads 10 through, for example, tubes (not shown). The sheet-feed unit 1*b* includes a sheet-feed tray 123, which holds a plurality of sheets P, and a sheet-feed roller 125, mounted to the sheet-feed tray 123. The sheets P in the sheet-feed tray 123 are successively sent out by the sheet-feed roller 125 starting with the topmost sheet, are guided by guides 127*a* and 127*b*, and are conveyed to the conveying unit 122 while being nipped by a feed roller pair 126.

The conveying unit 122 includes a plurality of, e.g., two, belt rollers 6 and 7, an endless conveying belt 8, a tension roller 9, and a supporting frame 11. The conveying belt 8 is an endless belt wound between the rollers 6 and 7. The tension roller 9 is urged downward while contacting an inner peripheral surface of the lower side of a loop of the conveying belt 8, such that a tension is applied to the conveying belt 8. The supporting frame 11 rotatably supports the rollers 6, 7, and 9. When the belt roller 7, which is a driving roller, is rotated clockwise in FIG. 1, the conveying belt 8 moves, and the belt roller 6, which is a driven roller, is also rotated clockwise in FIG. 1.

An upper side of the loop of the conveying belt 8 is supported by a platen 19 such that a surface of the belt extends parallel to the lower surface (or discharge surface in which many nozzles 18 (see FIG. 3) that discharge ink open) of each of the plurality of, e.g., four, heads 10 while being separated by a predetermined distance from the lower surface of each head 10. The plurality of heads 10 are provided side by side along the subscanning direction, and are supported by the housing 1*a* through a frame 3.

A fall prevention plate 12 bent into an L-like shape is disposed below the conveying unit 122. By the fall prevention plate 12, foreign matter that has fallen from, for example, the conveying belt 8 is held.

The surface of the conveying belt 8 includes a silicon layer having low adhesiveness. After a sheet P conveyed by the conveying unit 122 is pushed against the surface of the conveying belt 8 by a pressing roller 4, the sheet P is conveyed in the subscanning direction along solid black arrows while being held by the surface of the conveying belt 8 by adhesive strength of the surface of the conveying belt 8. A sensor 15 that detects the sheet P is provided directly downstream from the pressing roller 4 in the subscanning direction such that the sensor 15 opposes the upper side of the loop of the conveying belt 8. The controller 100 determines the position of the sheet P on the basis of a detection signal from the sensor 15, and controls driving of the heads 10.

When the sheet P passes directly below the plurality of, e.g., four, heads 10, inks of respective colors are successively discharged towards the top surface of the sheet P from the discharge surfaces of the heads 10, such that a predetermined color image is formed on the sheet P. Then, the sheet P is separated from the surface of the conveying belt 8 by a separation plate 5, is guided by guides 129*a* and 129*b*, and is conveyed upward while being nipped by a plurality of, e.g., two, conveying roller pairs 128. Then, the sheet P is discharged to the sheet-discharge section 131 from the opening 130 formed in the top portion of the housing 1*a*.

Next, the structure of each head 10 will be described in more detail with reference to FIGS. 1, 2, and 3.

Referring to FIG. 1, each head 10 includes a head body 10*a* and a reservoir unit 10*b* in that order from the lower side. Referring to FIGS. 2 and 3, each head body 10*a* includes a flow path unit 31, in whose lower surface a plurality of nozzles 18 that discharge ink are formed, and a plurality of, e.g., four, trapezoidal actuator units 21 (see FIG. 3), disposed in a staggered arrangement at the top surface of the flow path unit 31. Each reservoir unit 10*b* is secured to a portion of the top surface of the flow path unit 31 where the actuator units 21 are not positioned (that is, to an area including openings 105*b* divided as indicated by two dot chain lines in FIG. 2), and is disposed so as to oppose the actuator units 21 through a slight gap. The reservoir units 10*b* temporarily store ink supplied from the main tanks 121, and supply the ink to the flow path units 31 through the openings 105*b*.

Figure 3:
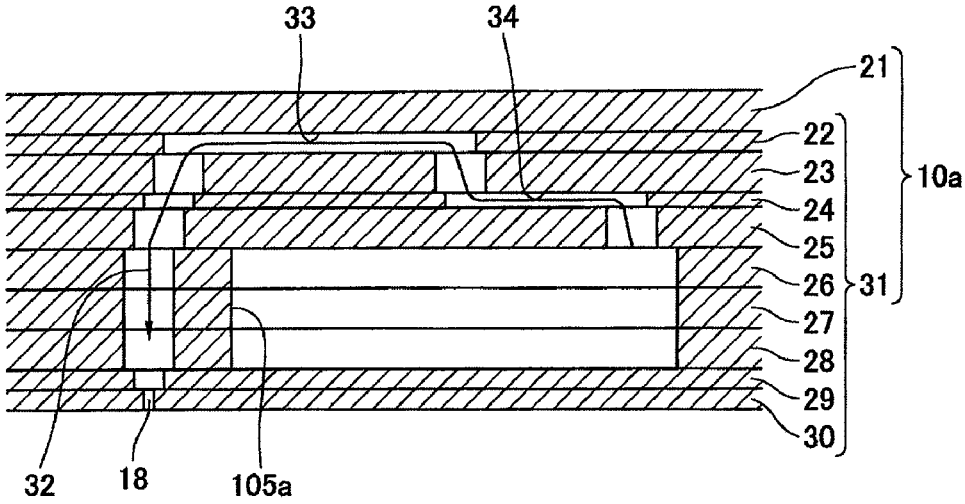
FIG. 3 is a partial sectional view of the head body.

Referring to FIG. 3, each flow path unit 31 is formed by stacking a plurality of, e.g., nine, metal plates 22, 23, 24, 25, 26, 27, 28, 29, and 30 (having many through holes formed therein) upon each other and securing them to each other while positioning them with respect to each other.

At the lower surface of each flow path unit 31, many nozzles 18 are formed in a matrix in an area corresponding to where the actuator units 21 are adhered. At the upper surface of each flow path unit 31, a plurality of pressure chambers 33 corresponding to the nozzles 18 are formed in a matrix similarly to the nozzles 18 in the area corresponding to where the actuator units are adhered, that is, an area covered by the actuator units 21. At the area corresponding to where the actuator units 21 are adhered, the plurality of nozzles 18 and the plurality of pressure chambers 33 are positioned side by side in the main scanning direction, and the nozzles 18 and the pressure chambers 33 are positioned in a plurality of rows in the subscanning direction (that is, the direction of conveyance of a sheet P). By driving the actuator units 21 under the control of the controller 100, ink is discharged from the nozzles 18 at the lower surfaces of the flow path units 31.

The openings 105*b* (see FIG. 2) are formed in the upper surface of each flow path unit 31 so as to avoid the actuator units 21. Manifold flow paths 105 (communicating with the openings 105*b*), sub-manifold flow paths 105*a* (which branch from the manifold flow paths 105 so as to extend in the main scanning direction), and a plurality of individual ink flow paths 32 (which branch from the sub-manifold paths 105*a*; see FIG. 3) are formed in each flow path unit 31. The plurality of ink flow paths 32 are formed with each nozzle 18.

Ink supplied into the flow path units 31 from the reservoir units 10*b* through the openings 105*b* flow to the manifold flow paths 105 and to the sub-manifold flow paths 105*a*. Then, the ink flows through apertures 34 and the pressure chambers 33 from the sub-manifold flow paths 105*a*, and is discharged from the nozzles 18.

Next, referring to FIG. 4, the controlling operation of each head 10 by the controller 100 during flushing will be described. Here, "flushing" means to discharge ink from the nozzles 18 for maintaining good discharge performance and for preventing thickening of ink in the nozzles 18 of the heads 10. Immediately before starting printing after the printing was not executed for a predetermined time, the following operations may be executed such that flushing of inks of respective colors other than black ink is carried out prior to carrying out black-color printing.

First, the controller 100 receives print data for a sheet P from a personal computer (PC), connected to the printer 1; stores the received print data in a memory, and detects a black-color print area on the sheet P from the print data (Step S1). Then, the controller 100 determines whether or not there is a flushing area in the black-color print area detected in Step S1 (Step S2).

Here, "black-color printing" refers to discharging black ink from the head 10K on the basis of the print data. "Black-color print area" refers to an area onto which black ink is discharged by the black-color printing, and is determined in pixels (or dots formed by discharging ink from one nozzle 18) as units in the main scanning direction and the subscanning direction. "Flushing area" refers to an area where flushing of inks of colors other than black (that is, cyan, magenta, and yellow) is performed.

In general, ink is discharged by a larger amount and at a higher speed when flushing is performed than when ink is discharged during ordinary printing. Therefore, in the embodiment, as a flushing area for every nozzle 18 (that is, an area where ink is assumed to land on a sheet P by flushing), an area for three pixels instead of one pixel is provided from a landing center position in the main scanning direction and the subscanning direction.

Figure 5A:
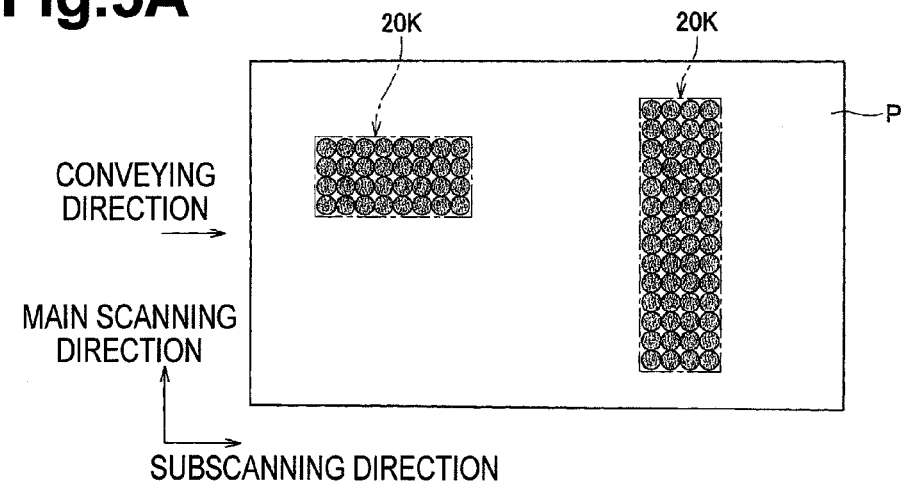
FIGS. 5A and 5B show a flushing area.

Flushing data may be formed such that inks subjected to flushing do not overlap each other. Therefore, for example, when a black-color print area 20K shown in FIG. 5A is detected, three pixels in the main scanning direction and the subscanning direction from a cyan (C) dot, a magenta (M) dot, and a yellow (Y) dot (an ink covering range formed on a sheet P when ink drops that have landed on the sheet P by flushing from the nozzles spread on the sheet P) are such that a flushing area of nozzles thereof does not overlap a flushing area of other nozzles.

In FIG. 5, for convenience, the black-color print area 20K is represented by light gray dots. However, since discharging of black ink to the black-color print area 20K is carried out after flushing, black dots are not formed during the flushing.

When the black-color print area includes two pixels or less in the main scanning direction or the subscanning direction, when, as mentioned above, a three-pixel area is a flushing area, the controller 100 determines that a flushing area does not exist in Step S2 (NO in Step S2). Then, black-color printing is carried out (Step S5) without carrying out flushing (Step S4) to end the actual process.

Figure 6:
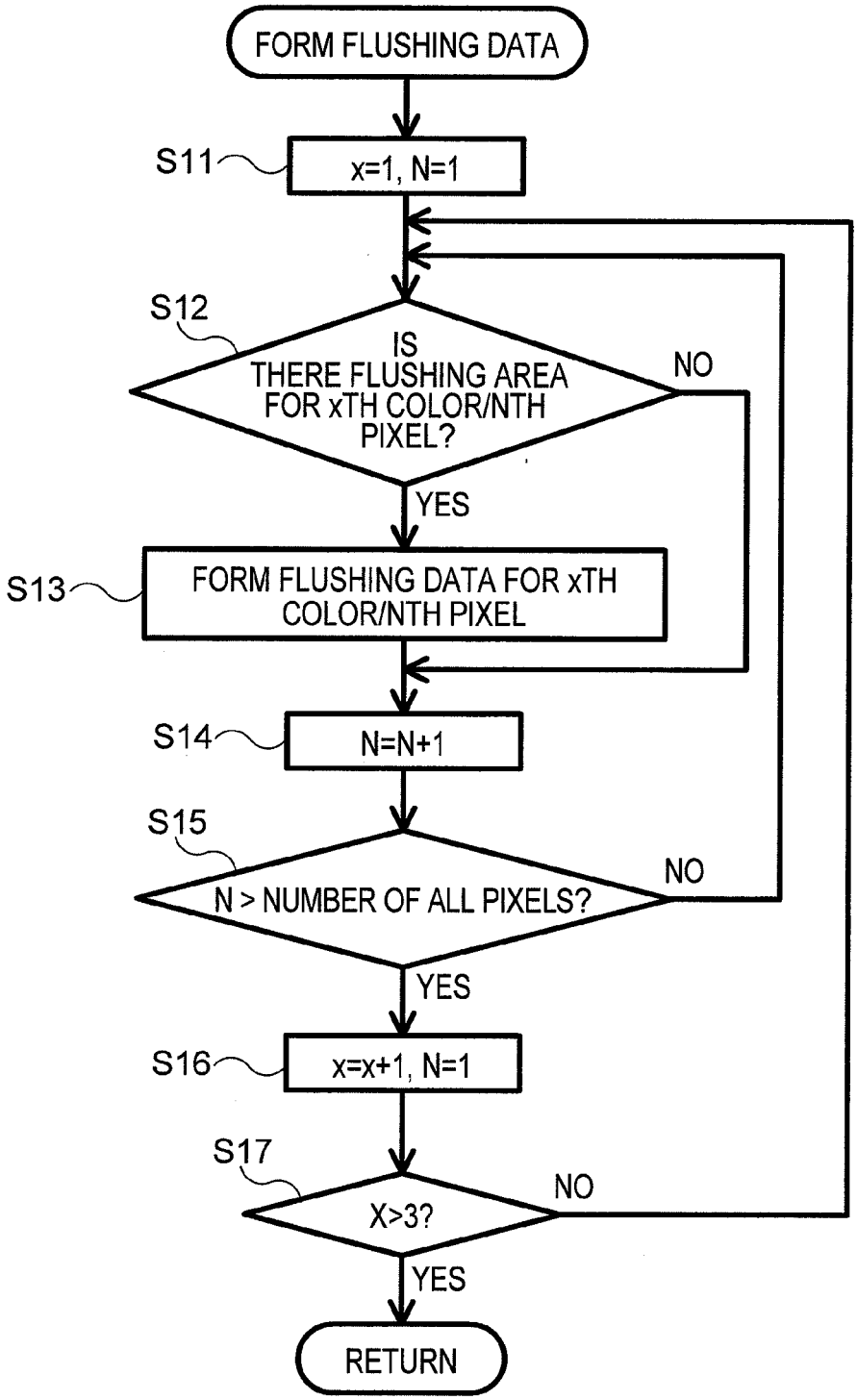
FIG. 6 is a flowchart of forming flushing data shown in FIG. 5.

In contrast, when the black-color print area includes three or more pixels in the main scanning direction or the subscanning direction, the controller 100 determines that there is a flushing area in Step S2 (YES in Step S2). Referring to FIG. 6, flushing data is formed (Step S3), flushing is carried out on the basis of the data (Step S4), and, then, black-color printing (Step S5) is carried out.

Next, the formation of the flushing data (Step S3) will be described with reference to FIG. 6.

First, the controller 100 performs a flushing-data formation process (such as determining the nozzle 18 where the flushing is performed and calculating a timing of the flushing from the nozzle 18) with each ink color and pixel in the black-color print area. Accordingly, for an xth pixel, x=1; and for an Nth pixel, N=1 (Step S11). In accordance with the order in which the heads 10 are arranged side by side, the first color may be cyan, the second color may be magenta, and the third color may be yellow. In the black-color print area, the pixels are called "first pixel," "second pixel," etc., one at a time, starting with a first row at an end of a sheet P in a widthwise direction (main scanning direction) and a first column at an end of the sheet P (see FIG. 5B).

The controller 100 determines whether or not there is a flushing area for the first color (i.e., cyan) starting with the first pixel (in the first column and first row) in the black-color print area Step S12). For example, in FIG. 5B, an area for three pixels is required as a flushing area in the main scanning direction and the subscanning direction. Therefore, for the pixels in the first column at the end of the sheet and the fourth column and the first row at one end of the sheet P in the sheet in the widthwise direction and the fourteenth row (the last row), the controller 100 determines that there is no flushing area (NO in step S12). In this case, an operation on a next pixel is carried out without forming flushing data for the pixels (Step S14).

Figure 5B:
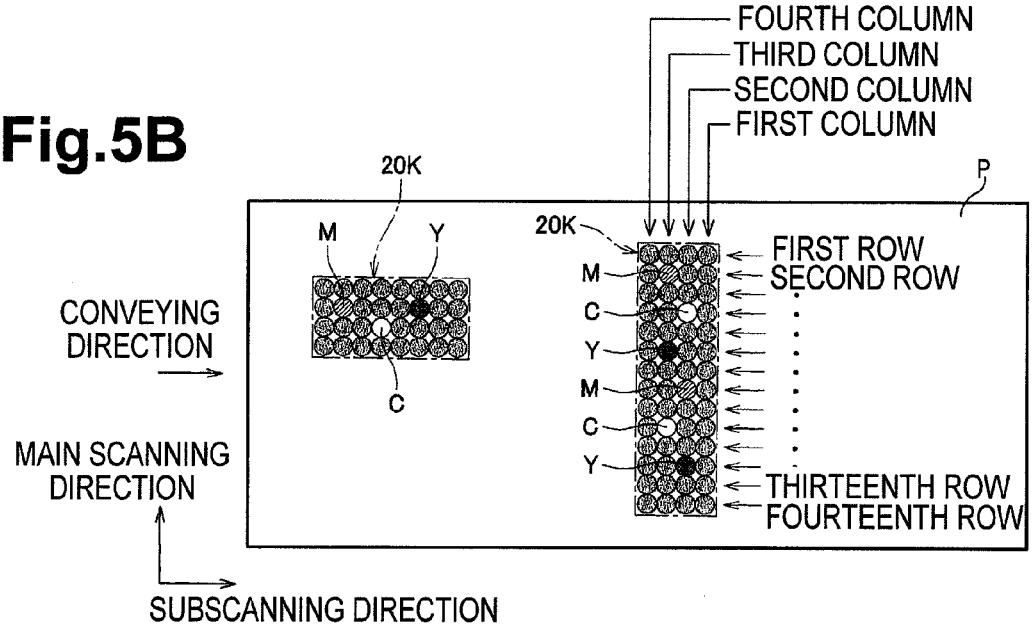

In contrast, in FIG. 5B, for the pixels in the second to the thirteenth row and the second column or the third column, a flushing area is provided. However, since flushing data is formed so that inks subjected to flushing do not overlap each other, the controller 100 may determine whether or not there is a flushing area in accordance with previously formed flushing data (Step S12). For example, for the pixel in the second column and the fourth row, flushing data for cyan ink is formed. Therefore, three pixels in the main scanning direction and the subscanning direction for this pixel cannot be used as a flushing area for other ink types. If, also considering, for example, the previously formed flushing data, the controller 100 determines that there is a flushing area (YES in Step S12), flushing data for this pixel is formed (YES in Step S13).

In this way, starting with the first column and the first row, an operation is performed up to the pixel in the last row and in the last column (that is, the pixel in the fourth column and the fourteenth row in the black-color print area 20K at an end of the sheet in FIG. 5B). Then, when the operations for all of the pixels in the black-color print area are performed, and N exceeds the number of all the pixels (YES in Step S15), similarly, the controller 100 determines whether or not there is a flushing area (Step S12) for the second color (magenta) (NO in Steps S16 and S17) starting with the first pixel in the black-color print area. After performing the operations for all of the pixels for the second color (i.e., magenta), the controller 100 performs similar operations for the third color (i.e., yellow).

Figure 4:
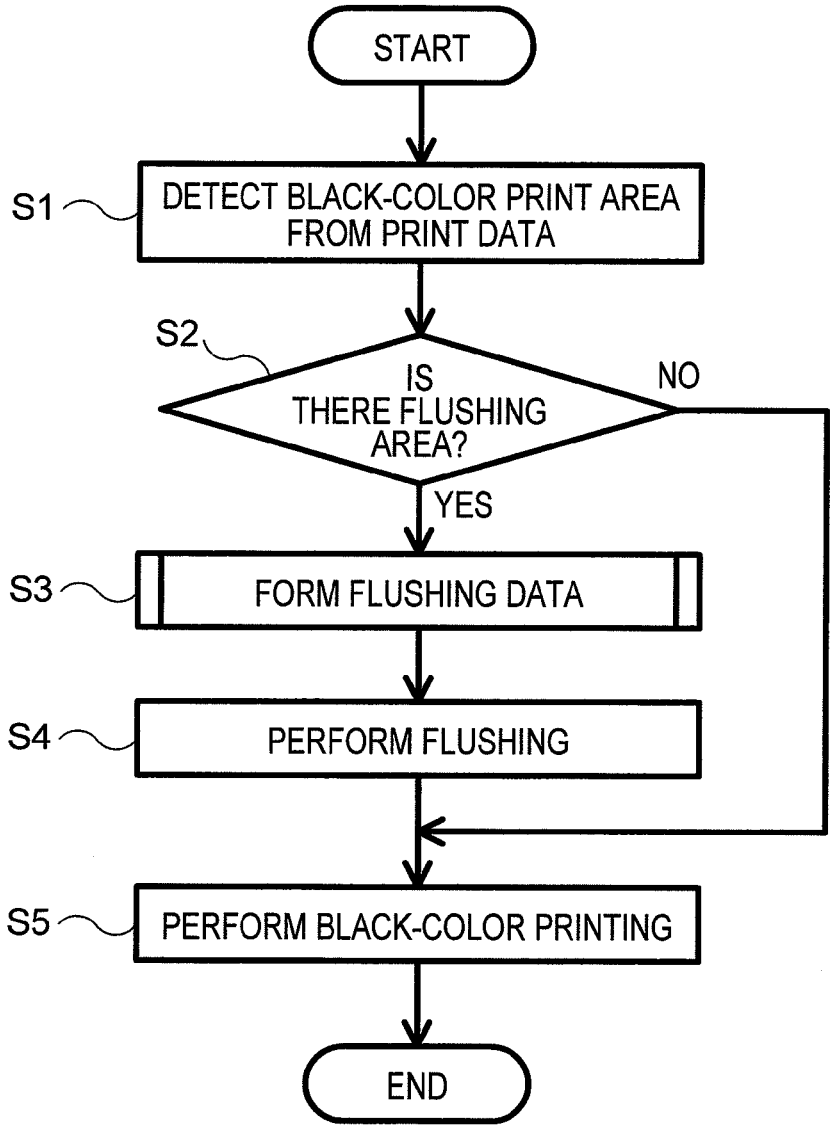
FIG. 4 is a flowchart of controlling the head by a controlling during flushing.

When the operations for the respective pixels in the black-color print area for all three colors end (YES in Step S17), the process proceeds to Step S4 in FIG. 4, such that driving of the heads 10C, 10M, and 10Y are successively controlled on the basis of the formed flushing data, to perform flushing.

From the viewpoint of ensuring discharge performance, flushing needs to be carried out for all of the nozzles 18 of each of the heads 10C, 10M, and 10Y. Therefore, when there are nozzles 18 at which flushing is not performed at a certain black-color print area (for example, an area 20K at an end of the sheet in FIG. 5B), data is formed such that flushing is performed from the nozzles 18 at the next black-color print area (the area 20K at the rear end of the sheet in FIG. 5B), or such that flushing is performed at the next area when flushing is not performed at the area 20K.

Figure 7:
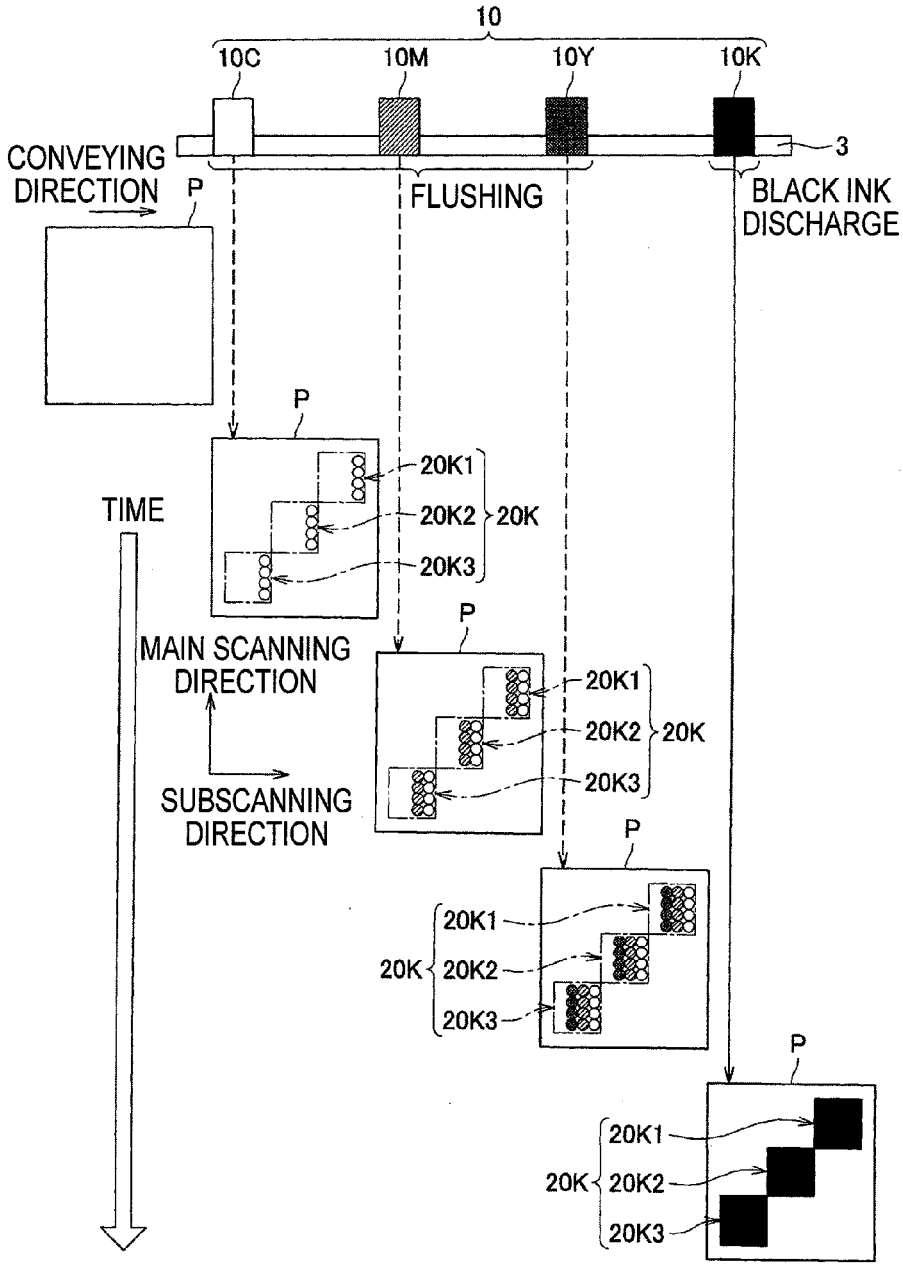
FIG. 7 is a schematic view of a situation in which black-color printing is carried out after carrying out flushing for each ink having a color other black.

In FIG. 7, there are three black-color print areas 20K on one sheet P. The length of each area 20K in the main scanning direction is shorter than the length of a nozzle-18 formation area in each head 10 (that is, a length L substantially equal to that of the area where the actuator units 21 are adhered shown in FIG. 2). In such a case, the controller 100 controls the heads 10C, 10M, and 10Y such that the nozzle-18 formation area is divided in accordance with the aforementioned length of the black-color print area 20K to perform flushing. By this, the flushing is performed at one black-color print area 20K from some of the nozzles 18 in the main scanning direction instead of from all of the nozzles 108 in the main scanning direction of each head.

More specifically, in FIG. 7, a first black-color print area 20K1, a second black-color print area 20K2, and a third black-color print area 20K3 are positioned in that order from an end of the sheet. In this case, data is formed such that flushing is carried out at the first black-color print area 20K1 from the nozzles 18 opposing the area 20K1 in the main scanning direction among all of the nozzles 18. In addition, data is formed such that flushing is carried out at the second black-color print area 20K2 from the nozzles 18 opposing the area 20K2 in the main scanning direction among all of the nozzles 18. Further, data is formed such that flushing is carried out at the third black-color print area 20K3 from the nozzles 18 opposing the area 20K3 in the main scanning direction among all of the nozzles 18.

In FIG. 7, for convenience of explanation, nine dots on the sheet P in FIG. 5 are simply shown as one dot. That is, in FIG. 7, an area having a width in correspondence with nine pixels and in which a dot formed by ink landing on the sheet P by flushing from one nozzle 18 functions as a center (that is, a "flushing area" for three pixels in the main scanning direction and the subscanning direction with one dot shown in FIG. 5 functioning as a center) is represented as one dot. In addition, four of such dots each are positioned in a column. The heads 10 are drawn with, for example, oblique lines in correspondence with the colors of the inks to be discharged. These points also apply to FIGS. 8 and 9 used to describe modifications of a controlling operation later.

Even in the example shown in FIG. 7, as mentioned above, when flushing data is formed such that inks subjected to flushing do not overlap each other, cyan ink, magenta ink, and yellow ink subjected to flushing are positioned so as not to overlap each other while being adjacent to each other.

As described above, according to the embodiment, since flushing of inks other than black ink (that is, cyan ink, magenta ink, and yellow ink) are subjected to flushing at the black-color print area 20K on the sheet P, it is not necessary to provide a different place that is separated from the print area (for example, a place situated forwardly or rearwardly of the print position of each head 10 shown in FIG. 1) as a dedicated flushing area, or it is not necessary to provide a dedicated flushing area on the sheet P. Accordingly, it is possible to simplify and reduce the size of the structure of the printer 1. It is not necessary to move each head 10 to the dedicated flushing area at, for example, a maintenance position when performing flushing, such that high-speed printing is achieved. Further, operations, such as cutting a portion of the sheet P, are not required. Therefore, there is no inconvenience in terms of workability.

Moreover, by performing flushing of inks other than black ink (e.g., cyan ink, magenta ink, and yellow ink), it is possible to restrict a change in color of an image printed on a sheet P. This is because, when black ink is discharged to the black-color print area 20K, it becomes difficult or impossible to distinguish between inks other than black ink (see FIG. 7).

The inks other than black ink are inks of two or more colors. The controller 100 controls the heads 10 such that the inks subjected to flushing at the black-color print area 20K do not overlap each other. By this, compared to when the flushed inks overlap each other, it is possible to reduce an ink drying time and an ink discharge amount in a particular portion of the black-color print area 20K.

The controller 100 calculates a timing in which flushing is performed at the black-color print area 20K with each ink color (refer to Steps S11 and S16 in FIG. 6), and causes flushing to be performed for each ink color at the calculated timing (refer to Step S4 in FIG. 4 and FIG. 7). By performing the flushing at a proper time with every ink color in this way, it is possible to reduce an ink consumption amount related to flushing compared to, for example, when flushing timing is set regardless of the ink color.

After performing flushing of the inks other than black ink at the black-color print area 20K (Step S4 in FIG. 4), the controller 100 controls the heads 10 such that black-color printing is performed (Step S5). This makes it possible to more effectively restrict a change in color of an image at the black-color print area 20K on the sheet P. This is because black ink is formed on the inks other than the black ink that have landed on the black-color print area 20K so as to cover the inks (see FIG. 7).

The plurality of nozzles 18 that discharge ink of the same color are formed in each head 10. Referring to FIG. 7, when the length of the black-color print area 20K is shorter than the length L (see FIG. 2) of the nozzle-18 formation area in the head 10 in the main scanning direction (which is orthogonal to the sheet-P conveying direction and which is parallel to a surface of a sheet P), the controller 100 controls the heads 10C, 10M, and 10Y such that flushing is performed by dividing the nozzle-18 formation area in accordance with the length of the black-color print area 20K. This makes it possible to properly and efficiently perform flushing by dividing the nozzle-18 formation area even if the length of the black-color print area 20K in the main scanning direction is short.

In the embodiment, the sheet P is conveyed in a predetermined direction (i.e., subscanning direction). Each head 10 is long in the main scanning direction (which is a direction orthogonal to the predetermined direction and parallel to a surface of the sheet P). The plurality of, e.g., three heads 10 are disposed side by side along the predetermined direction. When what is called line heads 10 are moved to, for example, maintenance positions (such as positions situated forwardly or rearwardly in the plane of the FIG. 1 of the print positions of the heads 10 shown in FIG. 1), the increase in size of the printer 1 becomes a serious problem. However, according to the the embodiment, this problem can be solved.

Next, referring to FIG. 8, a modification of controlling each head 10 by the controller 100 during flushing will be described.

Figure 8:
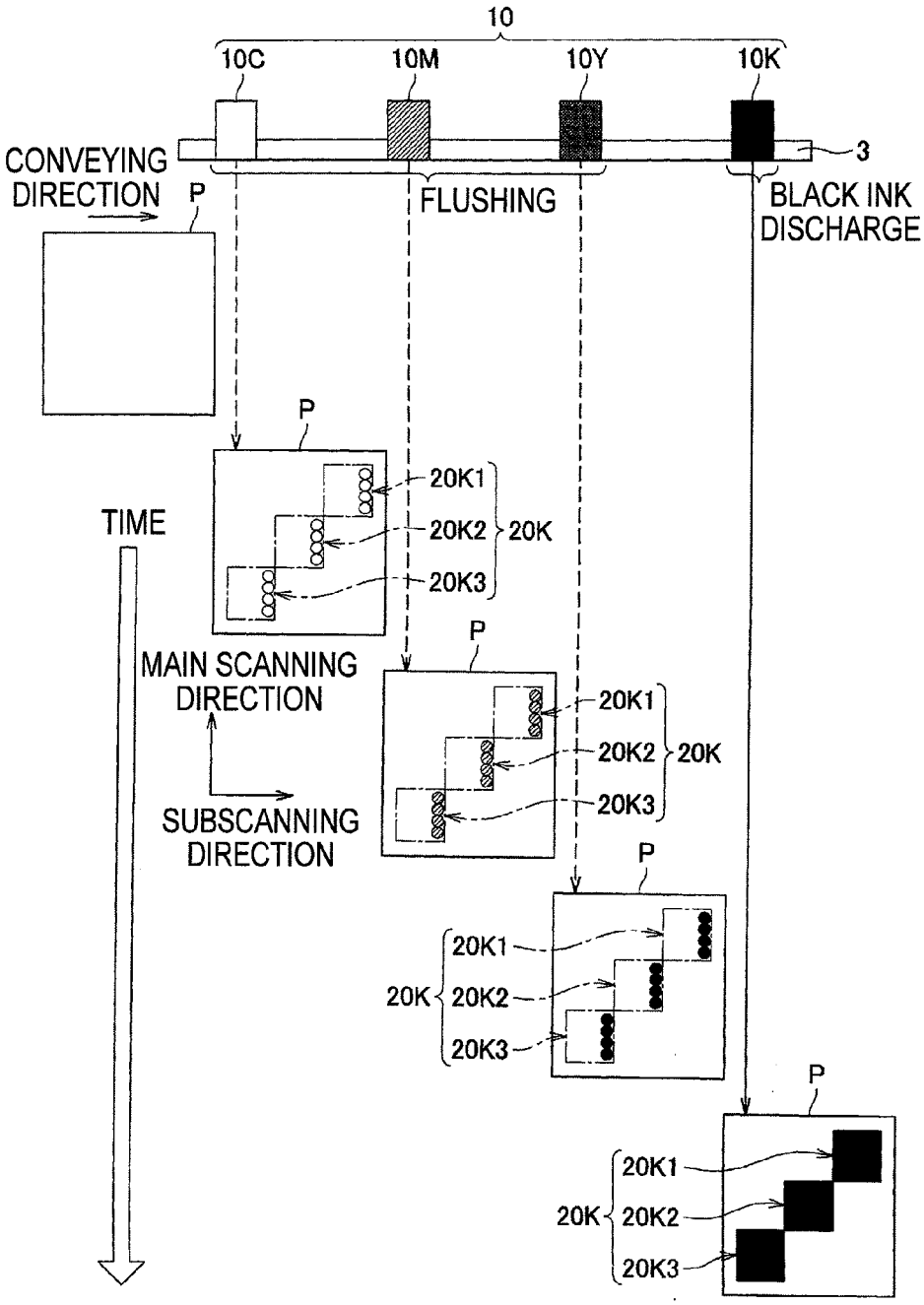
FIG. 8 shows a case in which the controlling operation is performed such that inks subjected to the flushing overlap each other and corresponds to FIG. 7.

Referring to FIG. 8, the modification differs from the above-described embodiment in that the controller 100 controls each head 10 such that inks of colors other than black ink that are subjected to flushing at the black-color print area 20K overlap each other. In forming flushing data in the modification, first, flushing data for the first color (e.g., cyan) is formed for every pixel of the black-color print area as in, for example, FIG. 6. For the remaining second color (e.g., magenta) and the third color (e.g., yellow), flushing data is formed on the basis of the flushing data for the first color (e.g., cyan) such that ink is discharged to a position that is the same as a discharge position of the flushing of the ink of the first color (e.g., cyan) at the black-color print area 20K.

As can be understood by comparing FIGS. 7 and 8 with each other, in the modification, since the area occupied by the inks other than black ink at the black-color print area 20K is small, it is possible to effectively restrict a change in color of an image at the black-color print area 20K on the sheet P.

As in the modification, when the inks other than black ink overlap each other, even if the length in the subscanning direction of the black-color print area 20K is short, it is possible to provide a flushing area and to efficiently perform flushing.

Further, in the modification, the ink colors other than black may be cyan, magenta, and yellow. When the plurality of, e.g., three, colors overlap each other, a substantially black color is provided. Therefore, it is possible to further effectively restrict a change in color of an image at the black-color print area 20K on the sheet P.

Next, referring to FIG. 9, controlling of each head 10 by the controller 100 when the length of the black-color print area 20K is long in the main scanning direction will be described.

Figure 2:
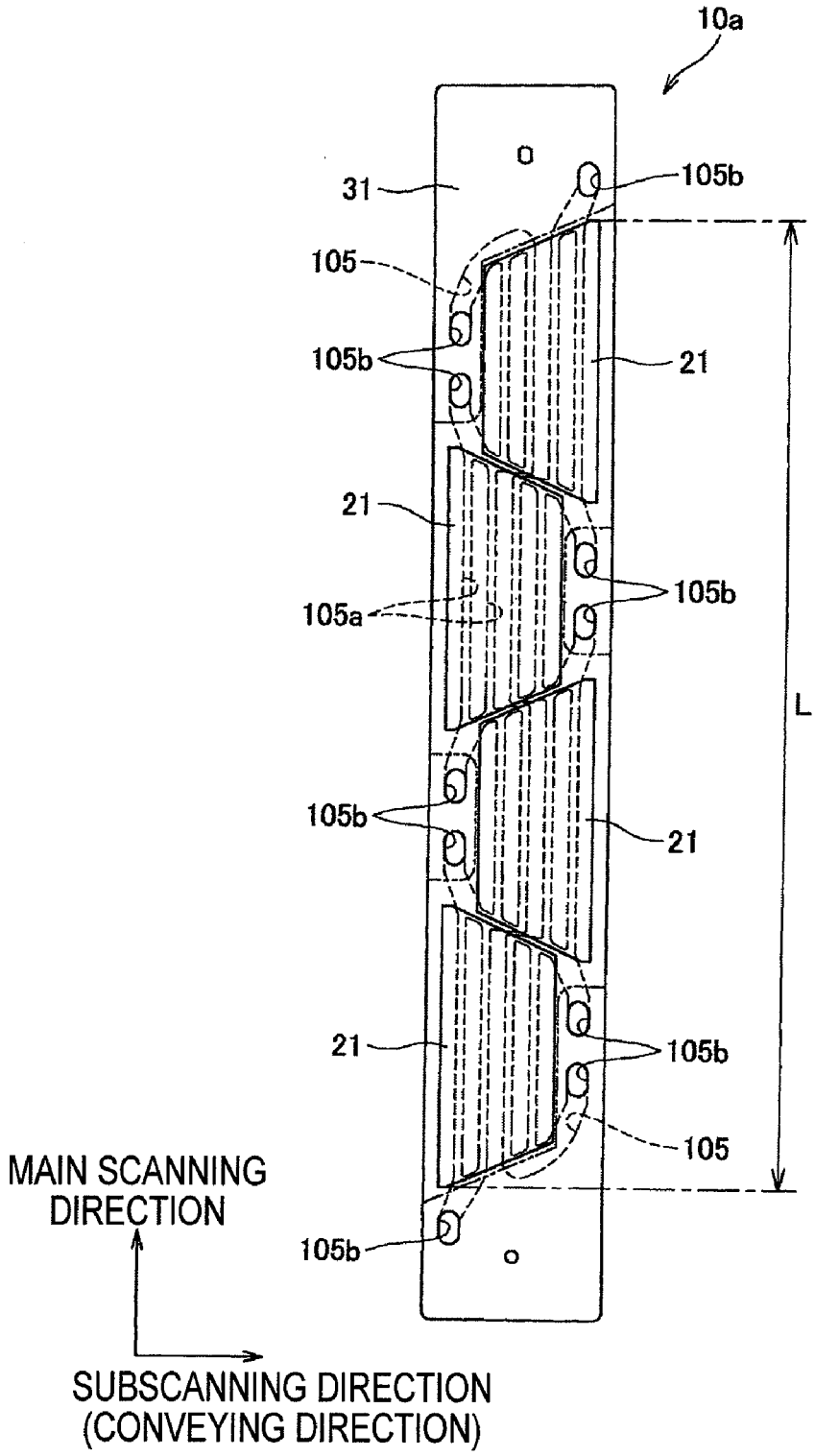
FIG. 2 is a plan view of a head body of an inkjet head.
Figure 9:
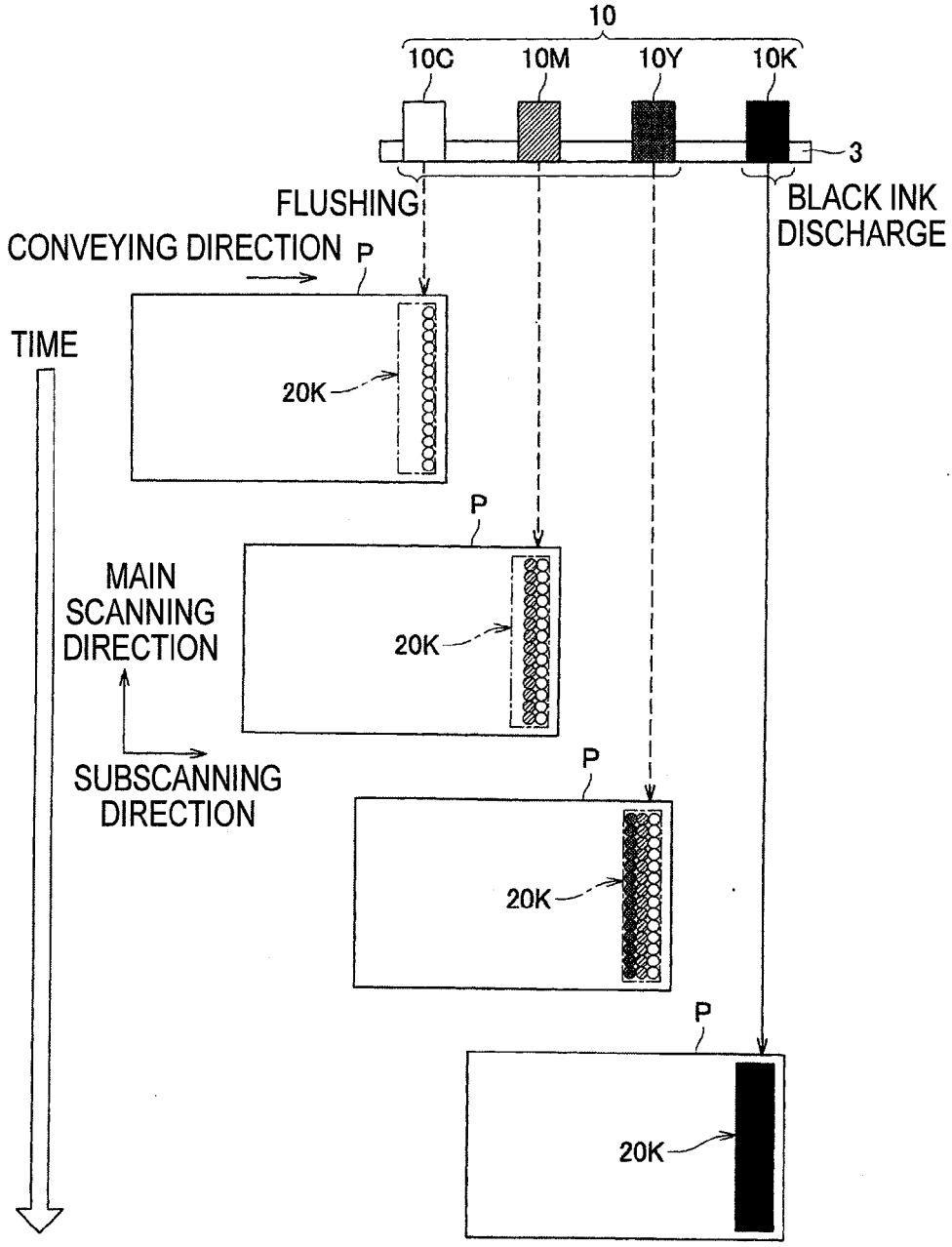
FIG. 9 is a schematic view of the flushing and the black-color printing when the length of a black-color print area is long in a main scanning direction, and corresponds to FIG. 7.

FIG. 9 shows a case in which the length of the black-color print area 20K in the main scanning direction is equal to the length L of the nozzle-18 formation area in the head 10 (see FIG. 2). In such a case, flushing is carried out from all of the nozzles 18, provided over the main scanning direction of each head, on one black-color print area 20K without dividing the nozzle-18 formation area in accordance with the length of the black-color print area 20K as it is in the above-described embodiment.

In the modification shown in FIG. 9, the inks other than black ink subjected to flushing do not overlap each other. However, they may overlap each other.

Figure 10:
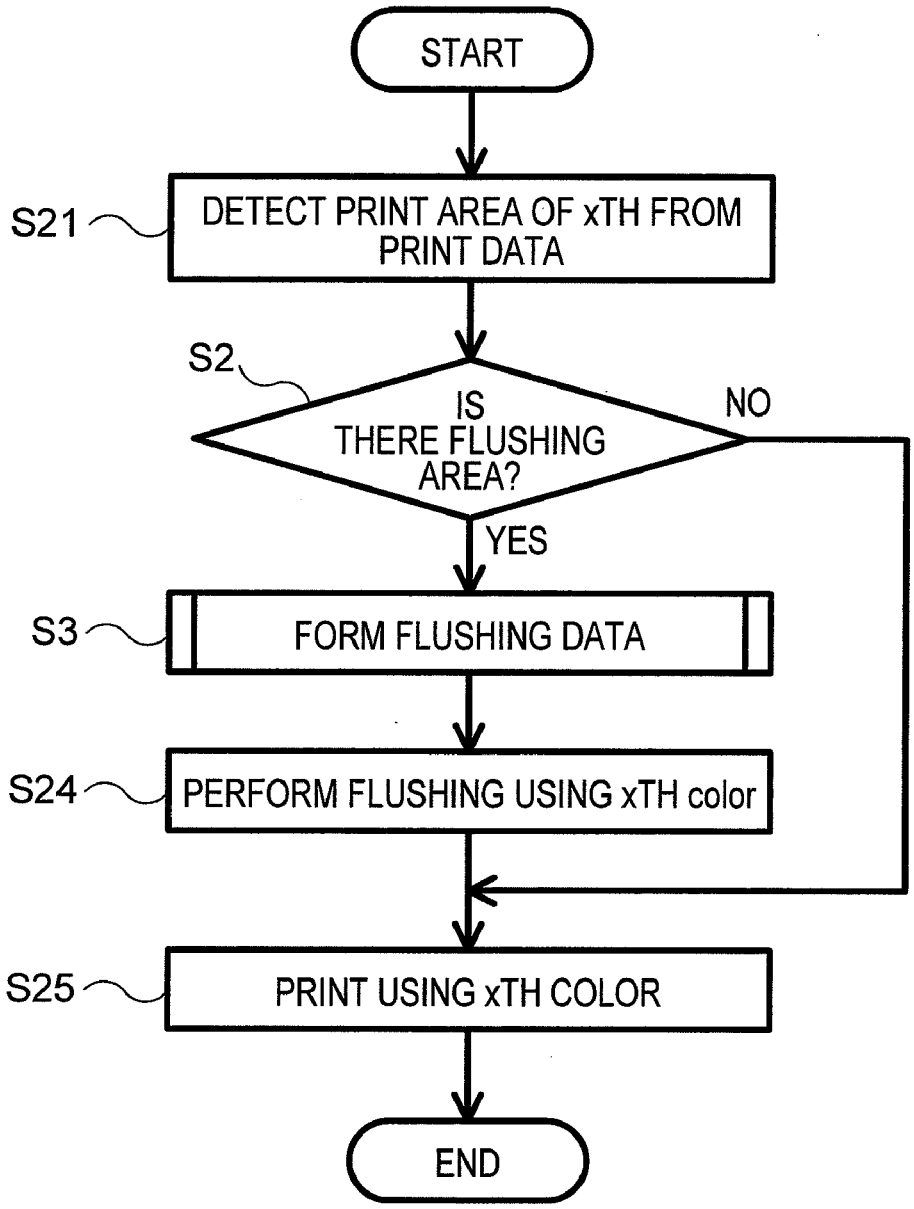
FIG. 10 is a flowchart of a modification of controlling the head by the controller during flushing.

Next, referring to FIG. 10, another modification of controlling each head 10 by the controller 100 during flushing will be described. In FIG. 10, steps that are the same as those in FIG. 4 are given the same reference numerals, and will not be described in detail below.

In the above-described embodiment, the controller 100 controls each head 10 such that the flushing of the inks other than black ink (that is, cyan ink, magenta ink, and yellow ink)

is carried out at the black-color print area 20K. In contrast, in the modification shown in FIG. 10, the controller 100 controls each head 10 such that flushing of ink of a color that is the same as that of ink discharged on the basis of print data is performed at an ink discharge area (i.e., print area).

More specifically, first, the controller 100 detects a print area of an xth color from the print data (Step S21). Then, when there is a flushing area at this print area (YES in Step S2), flushing data is formed (Step S3), and flushing of ink of the xth color is performed at the print area of the xth color in accordance with the flushing data (Step S24). Then, printing using the ink of the xth color is carried out on the print area where the flushing of the xth color has been performed Step S25.

Here, the aforementioned operations may be carried out with the first color being cyan, the second color being magenta, the third color being yellow, and the fourth color being black and with the value x being successively changed from 1 to 4. If it is determined that there is a nozzle 18 where flushing is to be performed (for example, it is necessary to recover discharge performance because ink is not discharged for a predetermined time or more), it is possible to carry out the aforementioned operations by detecting a print area corresponding to the color of ink discharged from the nozzle 18.

According to the modification, flushing of ink of a color that is the same as that of the ink that is discharged is performed at the print area of a sheet P. Therefore, it is not necessary to provide a different place that is separated from the print area as a dedicated flushing area, or to provide a dedicated flushing area on the sheet P. Consequently, similarly to the above-described embodiment, it is possible to simplify and reduce the size of the structure of the printer 1. In addition, since it is not necessary to move each head 10 to the dedicated flushing area at, for example, a maintenance position when performing flushing, high-speed printing can be realized. Further, operations, such as cutting a portion of the sheet P, are not required. Therefore, there is no inconvenience in terms of workability. Accordingly, similar advantages as those of the above-described embodiment are achieved.

Although a preferred embodiment of the present invention is described, the present invention is not limited to the above-described embodiment. Various modifications in design may be made.

For example, although, in the above-described embodiment, black-color printing is carried out (Step S5) after flushing of inks other than black ink at the black-color print area 20K (Step S4 in FIG. 4), it is possible to perform the flushing of the inks other than the black ink after performing the black-color printing. In the modification shown in FIG. 10, it is possible to perform flushing of ink of an xth color after printing using ink of the xth color.

Inks other than black ink subjected to flushing do not overlap each other at all in the embodiment (refer to FIG. 7). In the modification shown in FIG. 8, the inks other than black ink subjected to flushing completely overlap each other. However, as long as the inks are contained in the black-color print area K without protruding from the area 20K, they may be variously disposed. For example, they may partly overlap each other.

In the example shown in FIGS. 5A and 5B, an area for three pixels is required for ink flushing. However, the number of pixels in the flushing area varies in accordance with factors such as a discharge ink amount and an ink discharge speed for the flushing.

Although, in, for example, each of FIGS. 5 and 7, each black-color print area 20K is shown as being rectangular, the shape of each black-color print area 20K is simplified for convenience of explanation. Therefore, it may have various other shapes.

The number of heads 10 is not limited to 4. Any number of heads 10 may be used as long as the number of heads 10 is greater than or equal to 1. The colors of the inks discharged from the heads 10 are not limited to cyan, magenta, yellow, and black. One ink color other than black may only be used in the embodiment.

An image forming apparatus according to the invention is also applicable to either a line inkjet printer or a serial inkjet printer. Further, the image forming apparatus is applicable to, for example, devices other than printers, such as facsimiles or copying machines.

What is claimed is:

1. An ink discharging device comprising:

a head that is configured to print an image by discharging black ink and ink other than the black ink onto a print medium; and a print controller that is configured to control the head such that the image is printed on the print medium on the basis of print data, wherein the print controller is configured to control the head such that flushing of the ink other than the black ink is performed at a black-color print area on the print medium onto which the head discharges the black ink on the basis of the print data, wherein the head comprises a plurality of nozzles that are configured to discharge ink of the same color, and, wherein the print controller is configured to control the head, such that, when a length of the print area is less than a length of a nozzle formation area of the head in a direction orthogonal to a conveying direction and parallel to a surface of the print medium, the flushing is performed by dividing the nozzle formation area in accordance with the length of the print area, the conveying direction being a direction in which the print medium is conveyed with respect to the head.

2. The ink discharging device according to claim 1, wherein the ink other than the black ink comprises inks of two or more colors, and wherein the print controller that is configured to control the head such that the inks other than the black ink subjected to the flushing at the black-color print area do not overlap each other.

3. The ink discharging device according to claim 1, wherein the ink other than the black ink comprises inks of two or more colors, and wherein the print controller that is configured to control the head such that the inks other than the black ink subjected to the flushing at the black-color print area overlap each other.

4. The ink discharging device according to claim 1, wherein the ink other than the black ink comprises inks of two or more colors, wherein the ink discharging device further comprises a calculator that is configured to calculate a timing in which, with each ink color, the flushing is performed at the black-color print area, and wherein the print controller is configured to control the head such that the flushing is performed with each ink color at the timing calculated by the calculator.

5. The ink discharging device according to claim 1, wherein the print controller that is configured to control the head such that the black ink is discharged onto the black-color print area after performing the flushing of the ink other than the black ink at the black-color print area.

6. The ink discharging device according to claim 1, wherein the ink colors other than black are cyan, magenta, and yellow.

7. The ink discharging device according to claim 1, wherein the print medium is conveyed in a predetermined direction, wherein the head is long in a direction orthogonal to the predetermined direction and parallel to a surface of the recording medium, and wherein a plurality of the heads are provided side by side along the predetermined direction.

8. A method of controlling an ink discharging device that is configured to print an image by discharging black ink and ink other than the black ink onto a print medium from a head, the method comprising the steps of:

performing flushing of the ink other than the black ink at a black-color print area on the print medium onto which the black ink is discharged on the basis of the print data; and performing black-color printing, in which the black ink is discharged, at the black-color print area after the flushing, wherein the ink discharging device comprises a plurality of nozzles that are configured to discharge ink of the same color, and performing flushing by dividing the nozzle formation area in accordance with a length of the print area when the length of the print area is less than a length of a nozzle formation area of the ink discharging device in a direction orthogonal to a conveying direction and parallel to a surface of the print medium, the conveying direction being a direction in which the print medium is conveyed with respect to the head.

9. An ink discharging device comprising:

a head that is configured to print an image by discharging ink onto a print medium; and a print controller that is configured to control the head such that the image is printed onto the print medium on the basis of print data, wherein the print controller that is configured to control the head such that flushing of ink of a color that is the same as that of the ink that is discharged is performed at a print area on the print medium onto which the head discharges the ink on the basis of the print data, wherein the head comprises a plurality of nozzles that are configured to discharge ink of the same color, and wherein the print controller is configured to control the head, such that, when a length of the print area is less than a length of a nozzle formation area of the head in a direction orthogonal to a conveying direction and parallel to a surface of the print medium, the flushing is performed by dividing the nozzle formation area in accordance with the length of the print area, the conveying direction being a direction in which the print medium is conveyed with respect to the head.

* * * * *